United States Patent [19]

Brown

[11] Patent Number: 4,883,220

[45] Date of Patent: Nov. 28, 1989

[54] CONTINUOUS PARTIALLY PREPRINTED WEB FOR HEAT SEALED ENVELOPE CONSTRUCTION

[75] Inventor: Peter E. Brown, Everett, Canada

[73] Assignee: Moore Business Forms, Inc., Grand Island, N.Y.

[21] Appl. No.: 285,275

[22] Filed: Dec. 16, 1988

[30] Foreign Application Priority Data

Aug. 29, 1988 [CA] Canada ..... 575955

[51] Int. Cl.[4] ..... B65D 27/10

[52] U.S. Cl. ..... 229/69; 493/187; 493/198

[58] Field of Search ..... 229/69; 493/187, 198

[56] References Cited

U.S. PATENT DOCUMENTS

| | | | |
|---|---|---|---|
| 3,228,586 | 1/1966 | Hayes, Jr. | 229/69 |
| 3,302,861 | 2/1967 | Hiersteiner . | |
| 3,319,871 | 5/1967 | Hayes, Jr. | 229/69 |
| 3,392,907 | 7/1968 | Wadleigh et al. . | |
| 3,476,307 | 11/1969 | Faltin et al. | 229/69 |
| 3,487,966 | 1/1970 | Kampf . | |
| 3,537,638 | 11/1970 | Hyman . | |
| 3,559,875 | 2/1971 | Wilson | 229/69 |
| 3,726,471 | 4/1973 | Kalb . | |
| 3,764,061 | 10/1973 | Hulbert . | |
| 3,833,167 | 9/1974 | Kapitan | 229/69 |
| 3,837,565 | 9/1974 | Johnsen | 229/69 |
| 3,955,750 | 5/1976 | Huffman | 229/69 |
| 3,968,927 | 7/1976 | Katz et al. . | |
| 4,010,299 | 3/1977 | Hershey, Jr. et al. . | |
| 4,239,114 | 12/1980 | Denay | 229/69 |
| 4,310,117 | 1/1982 | Gullett . | |
| 4,418,865 | 12/1983 | Bowen | 229/69 |
| 4,575,121 | 3/1986 | Conti | 229/69 |
| 4,625,909 | 12/1986 | Ferrando | 229/69 |

FOREIGN PATENT DOCUMENTS

| | | | |
|---|---|---|---|
| 0925342 | 5/1973 | Canada | 229/69 |
| 2431964 | 3/1980 | France | 229/69 |
| 0567924 | 3/1945 | United Kingdom | 229/69 |

*Primary Examiner*—Stephen Marcus
*Assistant Examiner*—Kathryn M. Stemann
*Attorney, Agent, or Firm*—Nixon & Vanderhye

[57] ABSTRACT

A continuous partially preprinted, preglued form suitable for subsequent envelope construction comprises a single web partially preprinted on one side, having detachable marginal feed hole strips parallel with each longitudinal edge, and transverse marginal lines of perforations defining individual envelope forms with two transverse lines of perforations defining fold lines intermediate the marginal lines. On the side of the web opposite the preprinting, a first transverse adhesive strip is disposed immediately adjacent one of the transverse marginal lines and a second transverse adhesive strip is disposed parallel to the first transverse adhesive strip intermediate between that strip and the adjacent fold line. Two first aligned longitudinal adhesive strips lie parallel to one of the longitudinal edges adjacent a marginal feed hole strip with one adhesive strip extending between the transverse adhesive strips and the other extending between the transverse fold lines. Two second aligned longitudinal adhesive strips lie parallel to and coextensive with the first two longitudinal adhesive strips and spaced a predetermined distance therefrom, and a longitudinal line of perforations extends between the two transverse fold lines a predetermined distance from the other of said longitudinal edges. The web may then be variable printed on the preprinted surface, detached along the transverse marginal lines of perforations, folded and sealed to form complete envelopes.

6 Claims, 4 Drawing Sheets

CONTINUOUS PARTIALLY PREPRINTED WEB FOR HEAT SEALED ENVELOPE CONSTRUCTION

This application relates to a continuous partially preprinted and preglued web suitable for use in the production of heat sealed envelopes.

More specifically, the invention consists of partially preprinted, preglued continuous form stock for use by businesses, such as photographic film processors or retail outlets which arrange for such processing for customers, to produce film envelopes which have been custom printed for use by a specific business or retail outlet, which may be part of a chain or group of similar outlets. It is desirable that such outlets utilize envelopes which bear, for example, the name and address of the specific retail outlet, and a series or customer identification number, which will appear on both the film envelope and a customer claim check to ensure that a customer who leaves his film for processing will receive the correct negatives and prints when he returns to pick up the processed film. It is also desirable to include, on the film envelope computer readable bar codes identifying the retail outlet and the series number to permit automated handling of the film and envelope. While the invention is particularly suitable for use in the production of film envelopes, and will be described in that context, it will be appreciated that it may have other applications.

It is relatively costly, on a unit basis, for a forms manufacturer to preprint and form envelopes on an individual basis for each business or retail outlet which sells film and the like, and arranges for the processing of such film at the request of a customer. It is much simpler and much less costly to provide such outlets with a partially preprinted and preglued web of envelope form stock suitable for the formation of finished envelopes utilizing relatively simple printing and forming equipment. In other words, a retail outlet, or a chain of such outlets may be provided with packaqes of rolled or Z-folded continuous envelope form stock which has been partially preprinted with information common to all retail outlets, which has been appropriately perforated, cut, or weakened to form lines of severance, lines of separation and fold lines where appropriate, and which has applied thereto lines or strips of glue, such as heat activated or activatable glue to be used in the production of completed envelopes. Such stock may then be utilized by a retail outlet or chain or group of such outlets to produce customized envelopes with relatively inexpensive equipment for printing variable information (such as outlet name and address, series or customer identification number and bar code indicia), severing undesired material therefrom, such as detachable margins carrying tractor holes used to feed the web through automated processing equipment, separating the web into individual envelope forms or blanks, folding the envelope blanks, and heat sealing the folded blanks to form finished envelopes.

Through the use of a suitably preprinted and processed web, such envelopes may be readily provided with a detachable customer claims check, with a suitably reinforced panel bearing bar coding information suitable for automated handling, and all of the permanent and variable information required of such envelopes.

In a broad aspect, the invention resides in a continuous partially preprinted, preglued form suitable for subsequent envelope construction comprising: a single web partially preprinted on one side, having detachable marginal feed hole strips parallel with each longitudinal edge; transverse marginal lines of perforations defining an individual envelope form with two transverse lines of perforations defining fold lines intermediate said marginal lines of perforations; on the side of said web opposite said preprinting, a first transverse adhesive strip immediately adjacent one of said transverse marginal lines of perforations; a second transverse adhesive strip parallel to said first transverse adhesive strip intermediate between said first transverse adhesive strip and the adjacent fold line; two first aligned longitudinal adhesive strips parallel to one of said longitudinal edges adjacent a marginal feed hole strip, wherein one adhesive strip extends between said transverse adhesive strips and the other extends between said transverse fold lines; two second aligned longitudinal adhesive strips parallel to and coextensive with said first two longitudinal adhesive strips and spaced a predetermined distance therefrom; and a longitudinal line of perforations between said two transverse fold lines a predetermined distance from the other of said longitudinal edges.

In a further aspect, the invention resides in a process for the production of variable printed envelope forms which comprises the variable printing of said continuous partially preprinted, preglued form, detaching each individual envelope form along the transverse marginal lines of perforations, folding each individual form along the transverse fold lines and passing the folded envelope form through a heat sealer to activate the adhesive strips and complete the envelope.

In drawings which illustrate embodiments of the invention,

Figure 1:
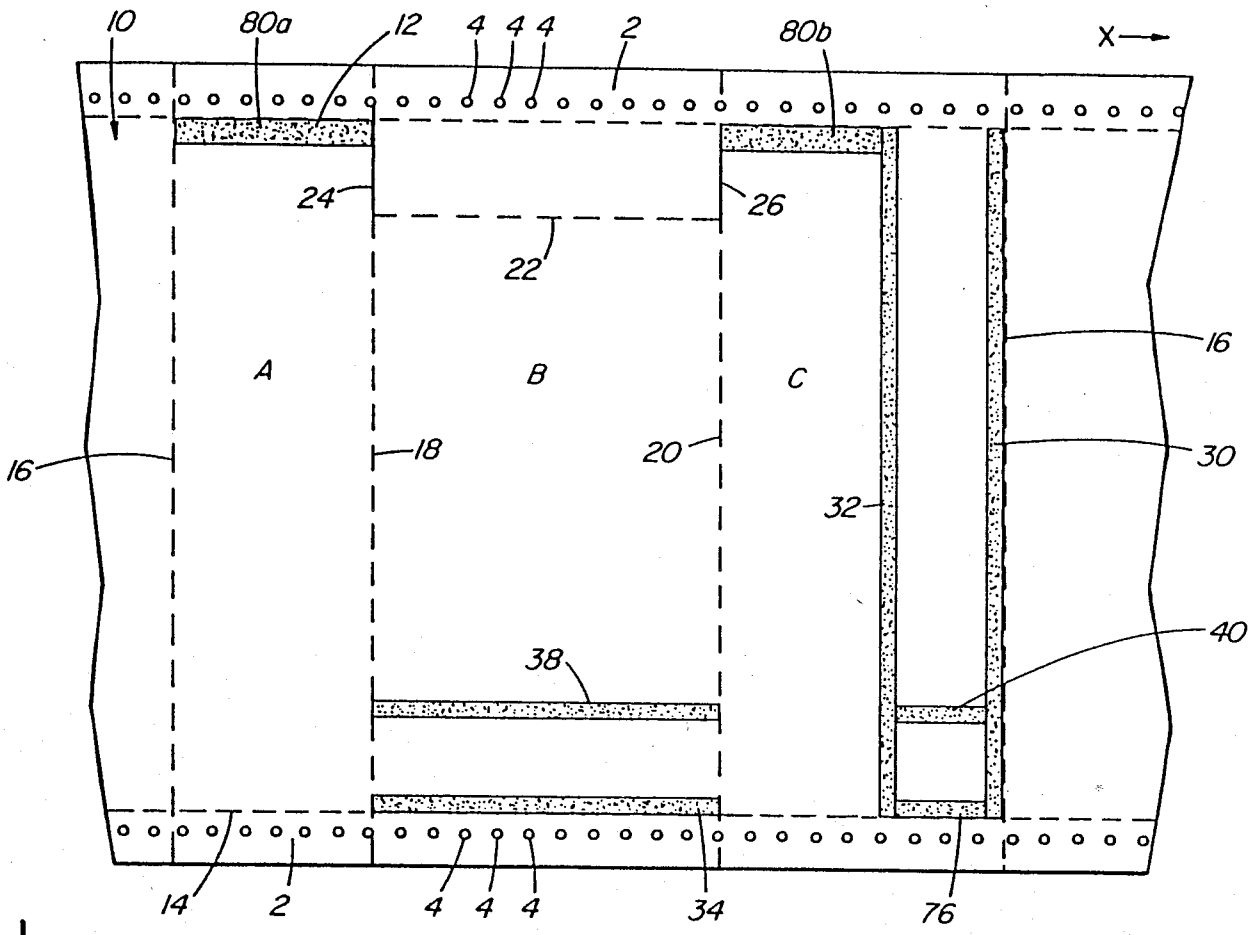
FIG. 1 is a plan view of a segment of a continuous web in accordance with the invention showing the surface thereof opposite the partially preprinted surface.

Referring now to FIG. 1, a segment of a continuous web 10 is illustrated which travels in the direction of the arrow X through conventional processing equipment to be described hereafter. The web 10 is provided with a top edge 12 and a bottom edge 14 and transverse lines of perforations 16 which define the margins of individual envelope forms. Marginal strips 2 carrying feed or tractor holes 4 are detachably secured to upper and lower edges 12 and 14 by means, for example, of lines of perforations coinciding with the upper and lower edges 12 and 14. Intermediate each pair of marginal lines of perforations 16 are intermediate lines of perforations 18 and 20 defining intermediate fold lines. Extending between the fold lines 18 and 20 is a line of perforations 22 which forms a line of severance or separation, and extending between line 22 and upper edge 12, and coincident with each fold line 18 and 20, is a through slit or line of severance 24 and 26 whereby the panel (108 in FIG. 4) defined by margins 12, 22, 24 and 26 may be readily separated from a completed envelope.

Disposed along one of the marginal lines of perforations 16 is a transverse adhesive strip 30, and parallel thereto, and spaced therefrom, is a second transverse adhesive strip 32. Disposed along the lower edge of the web, and extending between perforated fold lines 18 and 20 and between the two transverse adhesive strips 30 and 32 are two aligned adhesive strips 34 and 36 respectively, and spaced therefrom, and parallel thereto, are two further aligned adhesive strips 38 and 40.

Figure 5:
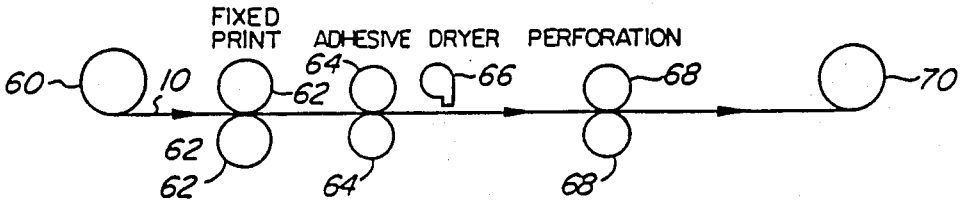
FIG. 5 is a schematic representation of the process of producing a continuous partially preprinted, preglued form in accordance with the invention.

The processing of the web of FIG. 1 is illustrated schematically in FIG. 5. The web stock is drawn from roll 60 through fixed printing rollers 62 which print information common to all forms on one side of the web (the side opposite that depicted in FIGS. 1 and 2). The web is then passed through glue and/or adhesive applicator rollers 64 which apply the adhesive strips to a surface of the web opposite the printed surface and thereafter the web is passed through a dryer which dries the adhesive. The web is then passed through perforation and/or slitting rollers 68 which apply the various lines of perforation, lines of severance or through slits to the web, and the preprinted, preglued and perforated web is then stored on a take-up roll 70 for subsequent delivery to a customer for further processing. While the web is, for illustrative purposes, shown as being stored in rolls, it is obvious that the web could also be stored in Z-folded packages or stacks instead of rolls.

While other forms of adhesive may be suitable for the purpose, the adhesive strips 30, 32, 34, 36, 38 and 40 are preferably composed of heat activated or activatable adhesive which can readily be activated under the application of heat and pressure.

Figure 6:
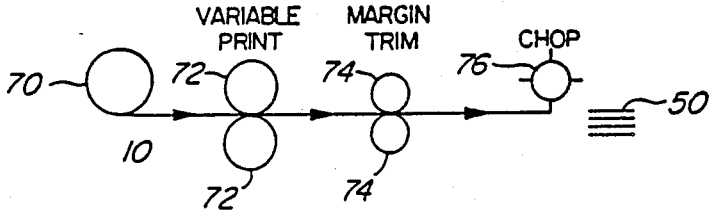
FIG. 6 is a schematic representation of the process for producing completed envelopes from the continuous partially preprinted, preglued form in accordance with the invention.

When a roll 70 of the preprinted, preglued and perforated web is delivered to a customer such as a film processing retail outlet, the web is subjected to additional processing as illustrated in FIG. 6. Specifically the web is passed through variable printing rollers or other printing apparatus 72 which apply variable printed matter to the preprinted side of the web, such as the name and address of the retail outlet, the series or customer identification number, and bar coding information adapted to identify the outlet and the series or customer identification number for automated handling. The web then passes through trim rollers 74 which remove marginal feed strips 2 from the web, and the web is then passed through a cutting or severing mechanism 76 which severs the web into individual envelope forms 50 which are stacked for subsequent folding under the application of heat and pressure to activate the adhesive strips to produce finished envelopes.

Figure 2:
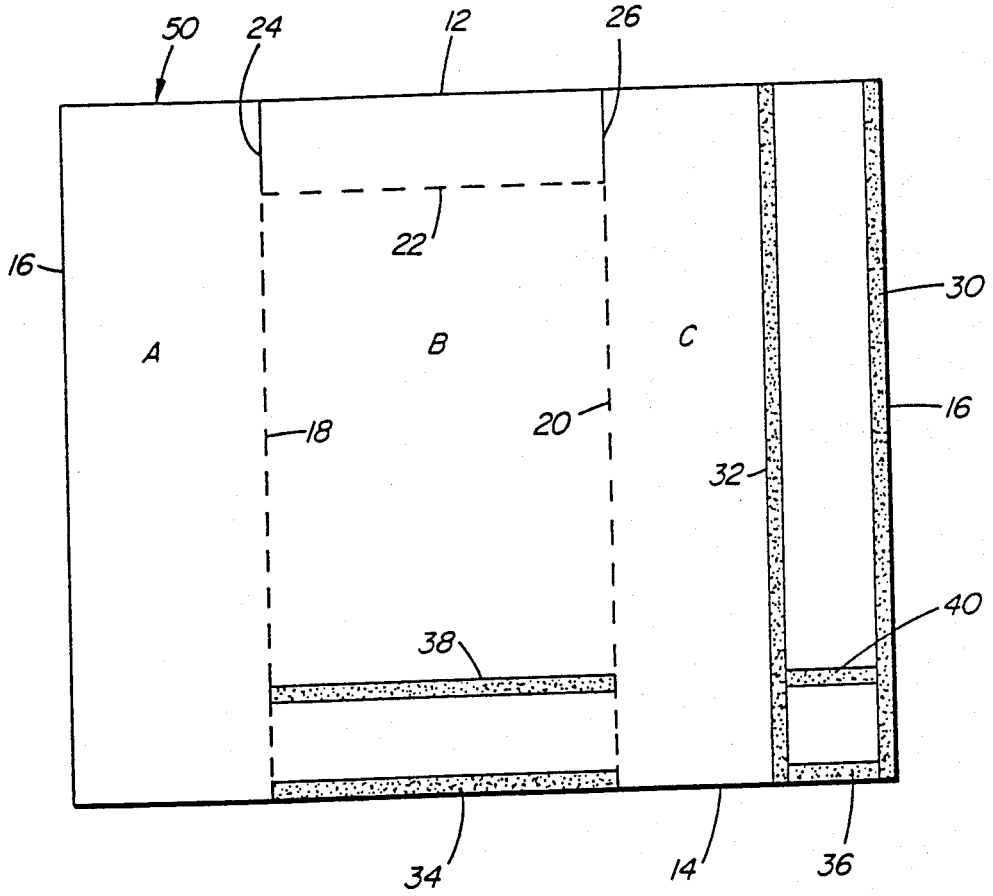
FIG. 2 is a plan view of an individual envelope form prior to folding and showing the surface opposite the partially preprinted surface.
Figure 4:
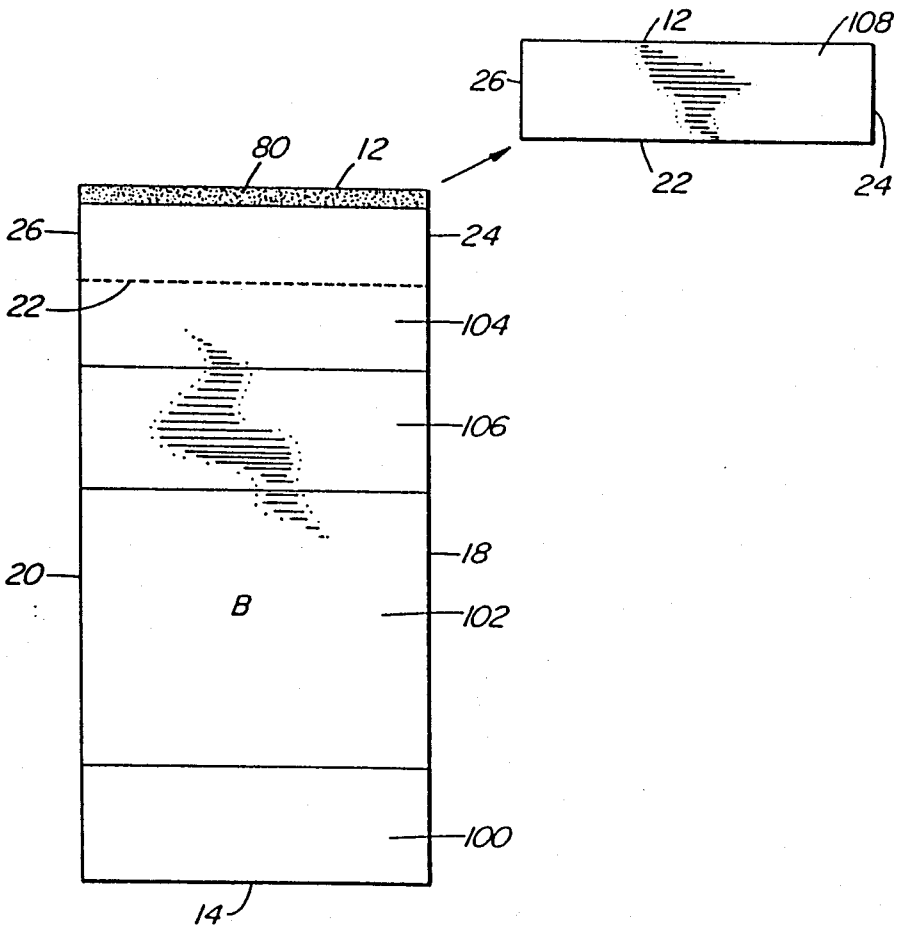
FIG. 4 is a plan view of the front side of a completed envelope showing the customer claim check panel removed therefrom.
Figure 3:
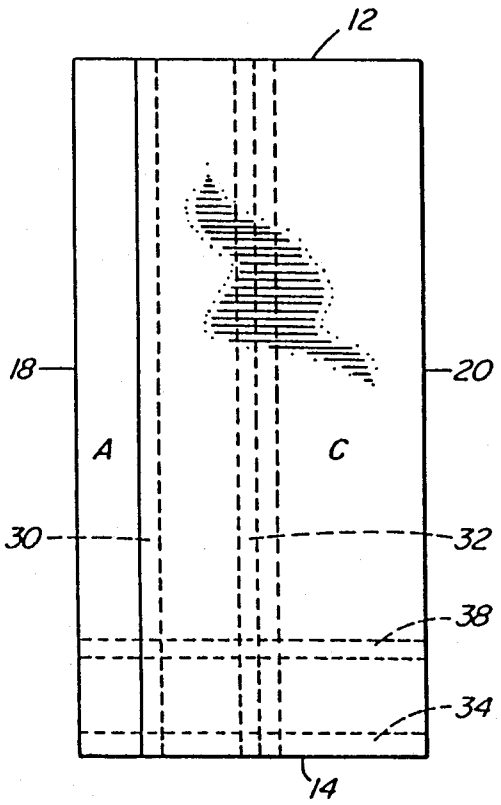
FIG. 3 is a plan view of the rear side of a completed envelope.

Referring now to FIGS. 2, 3 and 4, the finished envelopes are formed by folding panel A about fold line 18 over the side of central panel B bearing the glue strips 34 and 38, and thereafter folding side panel C over central panel B and the already folded over panel A as illustrated in FIG. 3. It will be apparent that the adhesive strips 30 and 32 will overlie panel A when folded, and preferably adhesive strip 32 will overlie the inboard edge of panel A. The folded structure is then subjected to heat and pressure to activate the adhesive strips and thus form an envelope ready for use.

With reference specifically to FIG. 4, the bottom portion 100 of the front face of the envelope will be relatively stiff, as it is defined by the two parallel lines of adhesive 34 and 36 and 38 and 40. This portion of the envelope is therefore particularly suitable for application of bar coding data thereto. Intermediate portions 102 and 104 may carry permanently printed data thereon such as lines and spaces for the insertion of a customer's name, address and phone number, data respecting the film left to be processed, and provision for miscellaneous instructions, whereas intermediate panel 106 may bear variable data such as the name, address and other identification of the retail store or outlet using the envelope as well as the customer number or the like, and the detachable customer claim check panel 108 may also include variable printed data such as the series or customer identification number. As explained previously, the panel comprising the customer claim check may readily be removed from panel C by tearing along severance line 22 bearing in mind that the side edges 24 and 26 have already been preslit and can readily be separated from the remainder of the formed envelope.

Preferably, it is desirable to utilize the projecting flap remaining after the customer claim check has been removed as a closure flap for the envelope, and it is therefore desirable, although not necessary, to provide the upper edge of this flap with a glue strip 80 which may be moisture activated. This can be accomplished during formation of the partially preprinted, preglued and perforated web by applying glue strip **80*a* and 80*b* adjacent the upper edge 12 and between full fold 18 and marginal edge 16, and between fold line 20 and transverse adhesive strip 32 respectively. The extending flap, best depicted in FIG. 4, can then be bent over edge 22, the glue strip 80 moistened, and the top of the envelope sealed after the contents have been inserted therein. For many applications the glue strip 80** may be unnecessary. For example, film envelopes are frequently closed by inserting the roll of film, rolling the envelope around the film and securing it with an elastic band, adhesive tape, or the like.

It will be apparent that, while the envelope is particularly suitable for use as a film envelope in retail outlets which arrange for the processing of exposed film, the envelope may have other applications. Where the envelope is used as a film envelope, a customer desiring to have film processed will leave the film with the retail outlet to arrange for processing; relevant data such as the customer's name, address, phone number, film type, or the like will be marked on the envelope, the customer claim check (panel 108) will then be torn off and given to the customer, and the envelope will be sealed either by folding over the exposed closure flap and sealing by means of glue strip 80, or folding over the closure flap and rolling the envelope about the roll of film or the like and seouring the rolled envelope with an elastic band, adhesive tape or the like.

THE EMBODIMENTS OF THE INVENTION IN WHICH AN EXCLUSIVE PROPERTY OR PRIVILEGE IS CLAIMED ARE DEFINED AS FOLLOWS:

1. A continuous partially preprinted, preglued form suitable for subsequent envelope construction comprising:

(a) a single web partially preprinted on one side, having detachable marginal feed hole strips parallel with each longitudinal edge;

(b) transverse marginal lines of perforations defining each individual envelope form with two transverse lines of perforations defining fold lines intermediate said marginal lines of perforations, (c) on the side of said web opposite said preprinting, a first transverse adhesive strip immediately adjacent one of said transverse marginal lines of perforations, (d) a second transverse adhesive strip parallel to said first transverse adhesive strip intermediate between said first transverse adhesive strip and the adjacent fold line of perforations, (e) two first aligned longitudinal adhesive strips parallel to one of said longitudinal edges adjacent a marginal feed hole strip wherein one adhesive strip extends between said transverse adhesive strips and the other extends between said transverse fold lines of perforations, (f) two second aligned longitudinal adhesive strips parallel to and coextensive with said first two longitudinal adhesive strips and spaced a predetermined distance therefrom, and (g) a longitudinal line of perforations between said two transverse fold lines of perforations a predetermined distance from the other of said longitudinal edges.

2. The form according to claim 1, including a through slit extending from each end of said longitudinal line of perforation's to said other longitudinal edge and coincident with each of said fold lines.

3. A form according to claim 2, including two aligned glue strips extending from said second transverse adhesive strip to the adjacent fold line of perforations, and from the other fold line of perforations to the adjacent marginal line of perforations, and along said other longitudinal edge.

4. A form according to claim 3, wherein said adhesive strips comprise heat activated adhesive material, and said glue strip comprises moisture activated adhesive material.

5. The form according to claim 1, 2 or 3, wherein each individual form comprises a first side panel extending from said one transverse marginal line of perforations to said adjacent fold line of perforations, a central panel extending between said fold lines of perforations, and a second side panel extending from the other fold line of perforations to the other marginal line of perforations whereby, when an individual envelope form is folded along said fold lines said first side panel overlaps said second side panel and said transverse adhesive strips overlie said second side panel with said second transverse adhesive strip lying adjacent said other marginal line of perforations.

6. A process for the production of variable printed envelope forms from a continuous partially preprinted, preglued form comprising a single web partially preprinted on one side, having detachable marginal feed hole strips parallel with each longitudinal edge, transverse marginal lines of perforations defining each individual envelope form with two transverse lines of perforations defining fold lines intermediate said marginal lines of perforations, on the side of said web opposite said-preprinting, a first transverse adhesive strip immediately adjacent one of said transverse marginal lines of perforations, a second transverse adhesive strip parallel to said first transverse adhesive strip intermediate between said first transverse adhesive strip and the adjacent fold line of perforations, two first aligned longitudinal adhesive strips parallel to one of said longitudinal edges adjacent a marginal feed hole strip wherein one adhesive strip extends between said transverse adhesive strips and the other extends between said transverse fold lines of perforations, two second aligned longitudinal adhesive strips parallel to and coextensive with said first two longitudinal adhesive strips and spaced a predetermined distance therefrom, and a line of longitudinal perforations between said two transverse fold lines of perforations a predetermined distance from the other of said longitudinal edges wherein said process comprises variable printing said continuous partially preprinted, preglued form on. the preprinted surface thereof; detaching said marginal feed hole strips and detaching separate variably printed envelope forms individual envelope forms along the transverse fold lines of perforations with the portion of said individual form free of said adhesive strips being first folded over the surface opposite said preprinted and variably printed surface, and the portion bearing said transverse adhesive strips being folded over said first folded portion; and passing said folded individual envelope form through a heat sealer.

* * * * *